US006052954A

United States Patent [19]

Dudek et al.

[11] Patent Number: 6,052,954

[45] Date of Patent: Apr. 25, 2000

[54] BURIAL STRUCTURE FOR THE NON-RETRIEVABLE INTERMENT OF HUMAN REMAINS AND SIGNIFICANT MEMORABILIA

[75] Inventors: Daniel T. Dudek; P. Rose Dudek, both of Rochester Hills, Mich.

[73] Assignee: Pyra Development, LLC, Knoxville, Tenn.

[21] Appl. No.: 09/071,923

[22] Filed: May 1, 1998

[51] Int. Cl.[7] ..... E04H 13/00; E04B 2/08; A61G 17/00

[52] U.S. Cl. ..... 52/128; 52/79.1; 52/133; 52/141; 52/236.3; 52/592.6; 27/7

[58] Field of Search ..... 52/79.1, 128 OR, 52/133, 134, 135, 136, 137, 139, 140, 141, 236.3, 236.9, 592.6, 605; 27/1, 7, 35

[56] References Cited

U.S. PATENT DOCUMENTS

| | | | |
|---|---|---|---|
| D. 167,522 | 8/1952 | Marlowe . | |
| D. 191,438 | 10/1961 | Paulson . | |
| D. 191,829 | 2/1961 | Cook . | |
| 304,101 | 8/1884 | Hatcher . | |
| D. 353,679 | 12/1994 | Corva . | |
| 481,370 | 8/1892 | Pruser | 52/139 |
| 799,373 | 9/1905 | Gaebler . | |
| 912,368 | 2/1909 | Downey . | |
| 980,750 | 1/1911 | Blyth . | |
| 1,050,256 | 1/1913 | Townsend, Jr. . | |
| 1,096,758 | 5/1914 | Rogers . | |
| 1,110,520 | 9/1914 | Woodard . | |
| 1,203,535 | 10/1916 | Graham . | |
| 1,237,823 | 8/1917 | Rothenberger . | |
| 1,288,254 | 12/1918 | Stanley . | |
| 1,340,656 | 5/1920 | Hughes et al. . | |
| 1,395,632 | 11/1921 | Easterday . | |
| 1,395,852 | 11/1921 | Mcmeans | 52/139 X |
| 1,453,375 | 5/1923 | Allen | 52/134 |
| 1,585,411 | 5/1926 | Patterson . | |
| 1,691,568 | 11/1928 | Gorman . | |
| 1,752,572 | 4/1930 | Person . | |

(List continued on next page.)

*Primary Examiner*—Beth A. Aubrey
*Assistant Examiner*—Brian E. Glessner
*Attorney, Agent, or Firm*—Paul S. Czarnota

[57] ABSTRACT

A burial structures providing space for multiple human remains, whether in form of a body or in the form of cremens, has the additional feature of allowing interlocking of the individual units. Unlike previous units, this interlocking occurs to prohibit access to the individual cremens or bodily remains. Thus, with the exception of a main level accessway, where some cremens are located within the walls, no individual remains are directly accessible. This building feature allows the heretofore unknown ability to form the mausoleum into innovative designs and shapes, from an obelisk shape, like the pyramids of Egypt, to religious symbolisms or aesthetic shapes, thus not solely relying on landscaping for giving beauty and reverence to the mausoleum and its surroundings. Each unit comprises an area for the remains, and alternately an area for any memorabilia to be placed with the remains. Formed of a high-strength synthetic material, the unit is sealed with a cover that has grooves formed therein. The bottom of the unit has corresponding tongues, which effect an interlocking relationship. The sides are designed to complement and complete this arrangement. Outer blocks not containing remains are disposed around the sides and atop the structure, with the base descending into the earth, the specific depth being determined by the height of the structure and geological conditions. This structure gives lasting, beautiful and reverent surroundings for the deceased, and is kept safe from vandals and other intruders.

20 Claims, 2 Drawing Sheets

U.S. PATENT DOCUMENTS

| | | | |
|---|---|---|---|
| 1,789,099 | 1/1931 | Fusco et al. . | |
| 1,858,722 | 5/1932 | Walker et al. . | |
| 1,860,023 | 5/1932 | Evard | 52/137 |
| 1,914,294 | 6/1933 | Richards . | |
| 1,964,234 | 6/1934 | Vogel . | |
| 1,981,324 | 11/1934 | Peterson . | |
| 2,038,300 | 4/1936 | Kuettner . | |
| 2,344,206 | 3/1944 | Forni . | |
| 2,525,017 | 10/1950 | Cheek et al. . | |
| 2,708,780 | 5/1955 | Burkhalter . | |
| 2,783,523 | 3/1957 | Halley . | |
| 2,853,870 | 9/1958 | Sinner et al. . | |
| 2,913,895 | 11/1959 | Blasius et al. . | |
| 3,230,674 | 1/1966 | Christensen | 52/236.9 X |
| 3,287,865 | 11/1966 | Lockman . | |
| 3,350,821 | 11/1967 | Jones . | |
| 3,372,519 | 3/1968 | Russell . | |
| 3,382,632 | 5/1968 | Grofcsik . | |
| 3,468,081 | 9/1969 | Saarinen . | |
| 3,486,287 | 12/1969 | Guillon . | |
| 3,510,997 | 5/1970 | Ratych . | |
| 3,596,419 | 8/1971 | Jaibert . | |
| 3,635,354 | 1/1972 | Martin . | |
| 3,642,339 | 2/1972 | Ruderfer . | |
| 3,643,814 | 2/1972 | Martin . | |
| 3,676,969 | 7/1972 | Moore . | |
| 3,754,805 | 8/1973 | Pangburn et al. | 52/136 X |
| 3,839,768 | 10/1974 | McQuestion | 52/135 X |
| 3,841,726 | 10/1974 | Andros et al. . | |
| 3,878,656 | 4/1975 | Duwe et al. . | |
| 3,913,741 | 10/1975 | Pirie | 206/508 |
| 3,958,378 | 5/1976 | Omeechevarria . | |
| 3,978,627 | 9/1976 | Booth . | |
| 4,031,678 | 6/1977 | Schuring . | |
| 4,048,772 | 9/1977 | Gaul . | |
| 4,073,100 | 2/1978 | DiGiovanni, Jr. . | |
| 4,102,098 | 7/1978 | Duwe et al. . | |
| 4,132,046 | 1/1979 | Duwe et al. . | |
| 4,143,494 | 3/1979 | Abbate | 52/139 |
| 4,277,924 | 7/1981 | Chimentin . | |
| 4,379,659 | 4/1983 | Steiner . | |
| 4,463,484 | 8/1984 | Valle Arizpe . | |
| 4,521,999 | 6/1985 | Flanagan . | |
| 4,671,706 | 6/1987 | Giardini . | |
| 4,688,359 | 8/1987 | See . | |
| 4,739,595 | 4/1988 | Yamagata . | |
| 4,780,994 | 11/1988 | Chen . | |
| 4,893,385 | 1/1990 | Schrag . | |
| 4,989,382 | 2/1991 | Spronken . | |
| 5,081,805 | 1/1992 | Jazzar . | |
| 5,163,258 | 11/1992 | Habraken et al. | 52/605 X |
| 5,243,794 | 9/1993 | Pikor . | |
| 5,287,603 | 2/1994 | Schorman . | |
| 5,301,398 | 4/1994 | Bursey, Jr. | 27/7 |
| 5,365,714 | 11/1994 | Potvin | 52/605 X |
| 5,381,591 | 1/1995 | Ponger et al. . | |
| 5,590,446 | 1/1997 | Hicks | 52/136 X |

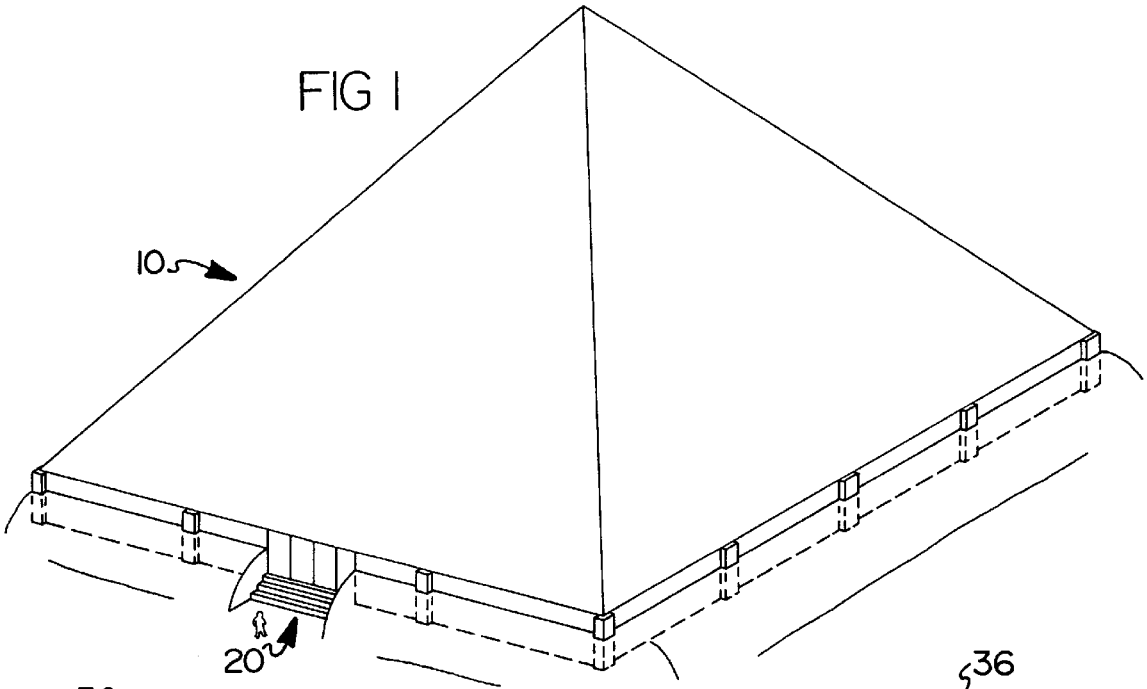
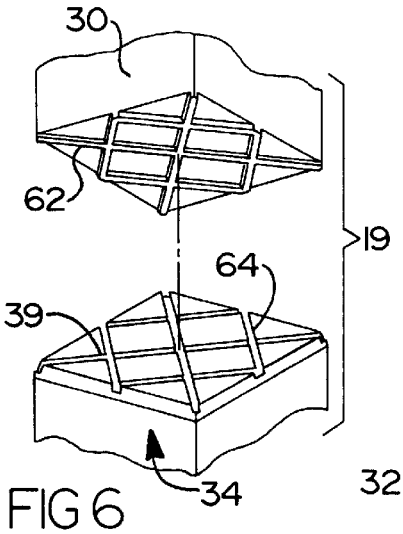
FIG 6
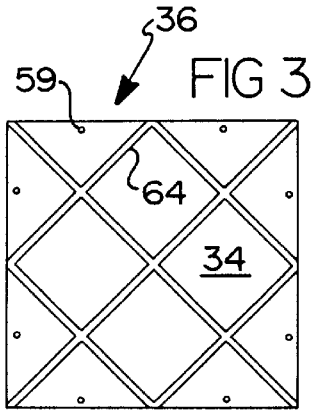
FIG 3
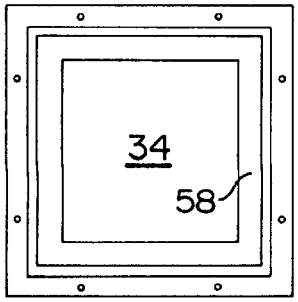
FIG 4
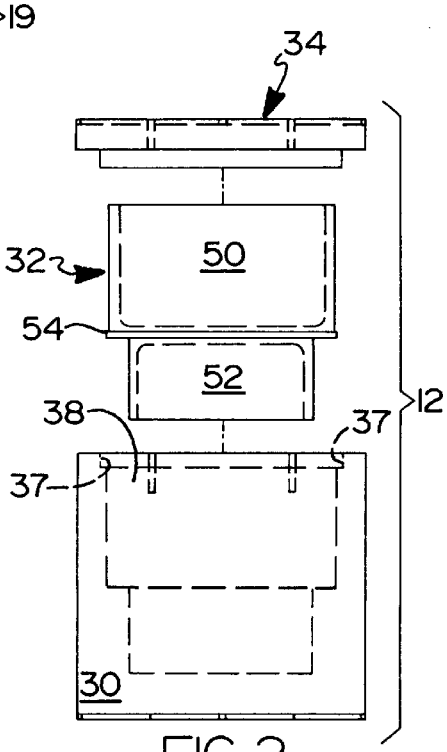
FIG 2
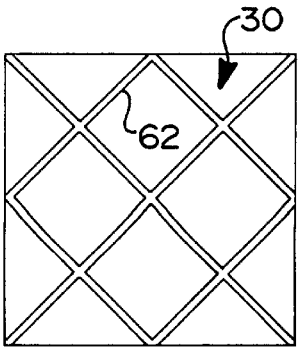
FIG 5

BURIAL STRUCTURE FOR THE NON-RETRIEVABLE INTERMENT OF HUMAN REMAINS AND SIGNIFICANT MEMORABILIA

BACKGROUND OF THE INVENTION

1. Field of the Invention

The present invention pertains to the burial of human beings after death. More particularly, the present invention concerns structures to contain the remains of multiple human beings therein. Even more particularly, the present invention pertains to burial structures for multiple numbers of human remains that render the remains contained therein unattainable and non-retrievable while effecting a proper, aesthetic and reverent memorial.

2. Prior Art

The funeral and after-death industry has long attended to the last needs of people. The traditional solution to the question of how to, in a dignified manner, dispose of the remains of the deceased has been either to bury the body in the earth or, if at sea, at the bottom of a large body of water. While these options will still be desired by many people, ecological concerns, considered in conjunction with the ever-growing world population and the increasing pressure to make available more arable land for crop production, will dictate in coming decades that other options be explored and more widely selected.

Excluding sea burial as a viable and ecological alternative, this leaves land burial. Even when sufficient tracks of land were available for the traditional burial of human remains in the ground, there has been the problems in the past of maintaining such properties in a fitting manner. Funding problems and simply the march of time have rendered often the corporations or people entrusted to oversee graveyards unable to fulfill their obligations, forcing state and local authorities to closely monitor such matters.

History has shown that such traditional methods of burial, even when expertly made to last millennia, will be subject to vandalism. A most famous case is the Egyptian pyramids, wherein the bodies were looted over time even though great strides were taken to conceal the burial chamber. This is due to the tact that workers needed to get out, and thus passages needed to be left.

Many cultures have considered cremation as a preferred means of laying to rest those of the community who have passed on. Even in western culture this option has risen in popularity. However, this option has encountered problems when carried forward in many areas, especially the United States.

One problem encountered has been the scattering of ashes. Many people have desired to spread the cremens of a loved one in a favorite park, lake or other area However, many state, local and religious laws forbid such actions. Further, these acts cause a pollution which, likely, is unintended by the deceased.

Even if the loved one does not scatter the remains, an awkward situation develops. The cremens are contained in an urn, which is then kept around one's home. Social situations of an unpleasant variety can occur when visitors see an urn in a home. Alternately, keepers of the remains may decide to move the remains to a less visible place, causing urns to be kept in closets, basements or other more secluded locations. None of these scenarios gives a dignified and reverent resting place for the deceased.

Another problem has been how the cemetery industry has addressed cremen remains. Many parks and cemeteries simply allot a smaller parcel of ground for the internment. Thus, while this allows the person to be interned in less area, the cost reduction is not paralleled by the commensurate reduced area of ground utilized. Alternately, the cemeteries have mausoleums in which cremens are placed, often with memorabilia and pictures of the deceased. While a fit and dignified option, this is more expensive. Further, the remains are easily accessible, giving no real security that vandals or others will not be able to desecrate the remains.

A concern to the wider population and its municipalities is the land dedicated to the burial of human remains. As populations have increased, and the attention and care given to cemeteries and memorial parks has risen, traditional methods of burial will cause great pressures on local land usages. Even where one area has enough land to allow in-ground burial, the financial pressures for alternate land uses often will make such locations economically burdensome. As already mentioned, history has demonstrated that cemeteries have, regrettably, fallen into disrepair and even been so overgrown that the cemeteries become lost. In such circumstances, the reverence and beauty of the final resting place is greatly diminished, and the lack of permanent care shown. While it is known that local and state laws strive to now avoid this occurrence, it is well known that simply passing a law does not ensure its adherence.

A final concern is the design of the mausoleums. Following the traditional design, such structures are usually boxes. At times, the structures are hidden, such as underneath drives or in chapels. Marble and other cold building materials are used, which does not invite one to make frequent visits to the site and, it visited, does not uplift one who does visit. Such traditional designs of mausoleums may not offer the appropriately high level of reverence for the deceased loved one, particularly noting the higher elevation of expectations of the people today.

One attempt to address this final concern is found in U.S. Pat. No. 4,780,994 issued to Chen. Chen teaches a honeycomb structure for internment of human remains. Multiple levels are built below ground, with crypts provided for interment of bodies. Aisleways are provided to visit individual crypts, where a marker is provided. Above ground, a structure is built, even in multiple stories, where cremens are contained. No particular structure is given for the building, and all remains are retrievable.

A similar facility in concept is found in U.S. Pat. No. 3,978,627 issued to Booth. Booth teaches a buried structure for multiple, stacked crypts, which can be visited by a friend or relative. One level may come above ground, but the entire structure is covered with earth, optimally in the form of a frusto-pyramid. All crypts can be visited. Again, these remains are retrievable.

Early mausoleum designs were concerned with building economical structures. Such mausoleums were often formed with common walls between crypts, or comprised a common area wherein multiple urns were placed. In all cases, these mausoleums allowed access ways to visit the remains.

Additionally, such structures should be termed to be retrievable storage places for the human remains. In defining this term, what is meant by retrievable is that the remains are simply stored behind a cover, such as in a crypt, or simply are buried in the ground. Any body or cremens buried in the ground is retrievable simply by digging up the remains. Likewise, crypts are accessible by unscrewing and removing the cover plate. These are characterized by a low degree of difficulty in retrieving remains.

Some patents have attempted to address vandalism. One such patent is U.S. Pat. No. 1,964,234 issued Vogel. Vogel teaches the use of a fusible material with the cover plate to increase the time necessary to remove the cover plate, as well as increasing its difficulty. Vogel asserts that vandals will need to take too long to open such a vault, such that they or the damage they have done will be discovered. This presumes, however, a watchful guard or a crypt that is visited often. As people move away from burial centers, such sites may be visited by loved ones infrequently, even only with the interval of years, and then only at holidays or birthdays. Thus, months or more could pass between visits, and a hidden crypt is ripe fodder for vandals.

History notes that in two famous cases, among others possible, the body of a famous person was buried in the ground underneath several feet of cement. This was first done with the grave of Abraham Lincoln, whose grave had been the target of vandals. Later, the outlaw John Dillinger was interred likewise due to expected grave robbers. To prevent desecration of the body of gangster Al Capone, the family finally buried the man in an anonymous grave. Such situations as these should not need be resorted to for a proper burial.

Despite the efforts of Vogel and others, graves as commonly known now are, to the definition of the term in this application, retrievable. Even bodies like Lincoln and Dillinger are retrievable, though the effort would require heavy equipment and several days of effort. What is seen as non-retrievable is any situation of interment that would require not only heavy equipment, but additionally identification means, such as a map to find particular remains. Further, such remains would require not merely days or weeks, but rather require years to retrieve at prohibitive cost. Further, the time necessary to retrieve the remains only can be counted once privacy contracts have either been waived or necessary court orders obtained to direct the retrieval, not to mention the redress of the rights of the other remains being disturbed therein.

Thus, what is needed is a burial option that allows more interments of cremens in a given space. Further, what is needed is a burial structure that prevents desecration of the cremens by rendering the remains unattainable. Additionally, what is needed is for structure to place the modern technology at the usage of visitors within a structure design that enhances the memory of the departed and draws one to visit them, while doing so in a special manner. It is to these needs that the present invention is directed.

SUMMARY OF THE INVENTION

The present invention is a burial structure for the interment of multiple human remains, the structure comprising:

a plurality of individual burial units, each burial unit being disposed either upon the flooring or atop another burial unit, each burial unit comprising:

an outer container having a chamber formed therein;

an inner container which fits into the chamber of the outer container, the inner container holding the human remains to be stored in the individual burial unit;

a cover; and a plurality of outer blocks surrounding and capping the individual burial units;

wherein the individual burial units directly contribute to the formation of the aesthetical portion of the burial structure.

The burial structure may further comprise an entryway and a main hallway, and a flooring upon which the containers and outer blocks are deployed atop.

The burial structure may further comprise means for sealing the cover to the outer container, and further comprise means for interlocking the containers stacked atop each other, and means for securing the cover to the outer container.

A second or alternate embodiment for a burial structure for the non-retrievable interment of human remains and any associated memorabilia therewith while forming a lasting memorial structure thereby to those therein interred may comprise:

a floor;

a plurality of containers to hold the human remains, each container comprising a bottom and a plurality of side walls cooperating to define a chamber, and further comprising a cover which fits atop the side walls parallel to the bottom of the container and acting to seal the chamber formed therein the container, wherein each container is either mounted upon the floor or upon another container;

a plurality of outer blocks, the blocks being deployed upon floor circumferentially about the deployment of the containers or being deployed upon each other, the blocks having means for interlocking with each other, the blocks providing the outer shell and protection for the burial structure.

Means for securing each cover to the side walls of its respective container is envisioned as part of the present invention. The floor has formed therein a plurality of slots. The slots formed in the floor are also deployed in a cross-hatch pattern ideally.

It is found in the burial structure that the bottom of each container may have formed thereon a plurality of ridges, and the cover of each container has formed therein a plurality of slots, wherein the ridges and slots are so formed as to be capable of mating and thereby interlocking the containers.

Additionally the bottom of each container has formed thereon a plurality of ridges, and the cover of each container has formed therein a plurality of slots, wherein the ridges of the containers and the slots of the floor and the covers are so formed as to be capable of mating and thereby interlocking the containers and the floor.

In the burial structure, the outer blocks have means for mating with the slots formed in the floor.

The burial structure in all embodiments may further comprise a capstone outer block, the capstone outer block being interlocking with the surrounding outer blocks onto which it is mounted, the capstone outer block and all other outer blocks cooperating to secure the burial container therewithin, the capstone block being sealable atop the containers and outer blocks upon which it is deployed.

The alternate embodiment of the burial structure of the present invention has the containers and outer blocks so disposed as to form a hallway and an entrance to the hallway substantially at ground level, the hallway being formed by outer blocks within the structure, such that the containers are not readily accessible from the hallway. The burial structure further comprises means for securing the cover to the outer container of each individual burial unit. The burial structure further comprises means for sealing the cover to the outer container of each individual burial unit.

A final particular embodiment of the burial structure for the non-retrievable interment of human remains and any associated memorabilia therewith, while forming a lasting memorial structure to those thus interred, comprises:

a floor having a plurality of slots formed therein, the floor being deployed below the grade of the land by a minimum of thirty feet;

a plurality of burial containers, the burial containers comprising at least one compartment formed of a high impact polymer, each burial container having a cover, a bottom and a plurality of sides cooperating to define an interior chamber, the chamber being where the human remains or memorabilia will be interred, the cover being mountable upon the plurality of sides to close the chamber, wherein the cover of each container has formed therein a plurality of slots in a manner similar to the floor, and wherein further the bottom of each container has a plurality of ridges formed thereto, the ridges being capable of interlocking insertion into the slots of either the floor or the top of another container, and wherein further the containers are stacked upon the floor and each other in an interlocking manner to provide greater building stability and to allow a hallway to be formed therein, the interlocking of containers serving as building blocks for the memorial structure;

means to secure the cover to the outer container of each individual burial unit;

a plurality of outer blocks of cement deployed upon the floor and circumferentially around all containers, outer blocks being deployed further in a stacking manner atop other outer blocks so as to enclose all containers therein while allowing for a hallway entrance to be formed, the outer blocks serving to seal the containers from both the ground and the outside atmosphere, the blocks being water and gas impermeable, the blocks having means for interlocking so as to comprise a barrier to access to the containers therein;

means for sealing the cover to the outer container of each individual burial unit; and a capstone block which is sealed to the top of the burial structure to seal off the structure. The present invention will be more clearly understood by the following detailed description, with reference being made to the accompanying drawings, in which like reference numerals refer to like parts, in which:

BRIEF DESCRIPTION OF THE DRAWINGS

FIG. 1 is a perspective view of the burial structure of the present invention in an environmental setting;

FIG. 2 is an exploded view of the components of an individual burial unit of the burial structure of the present invention;

FIG. 3 is a top view of the cover of the individual burial unit of the present invention;

FIG. 4 is a bottom view of the cover of the individual burial unit of the burial structure of the present invention;

FIG. 5 is a bottom view of the outer container of the individual burial unit of the burial structure of the present invention;

FIG. 6 is an exploded view of a top of one container interacting with the bottom of a second container of the present invention.

DETAILED DESCRIPTION OF THE PRESENT INVENTION

Figure 7:
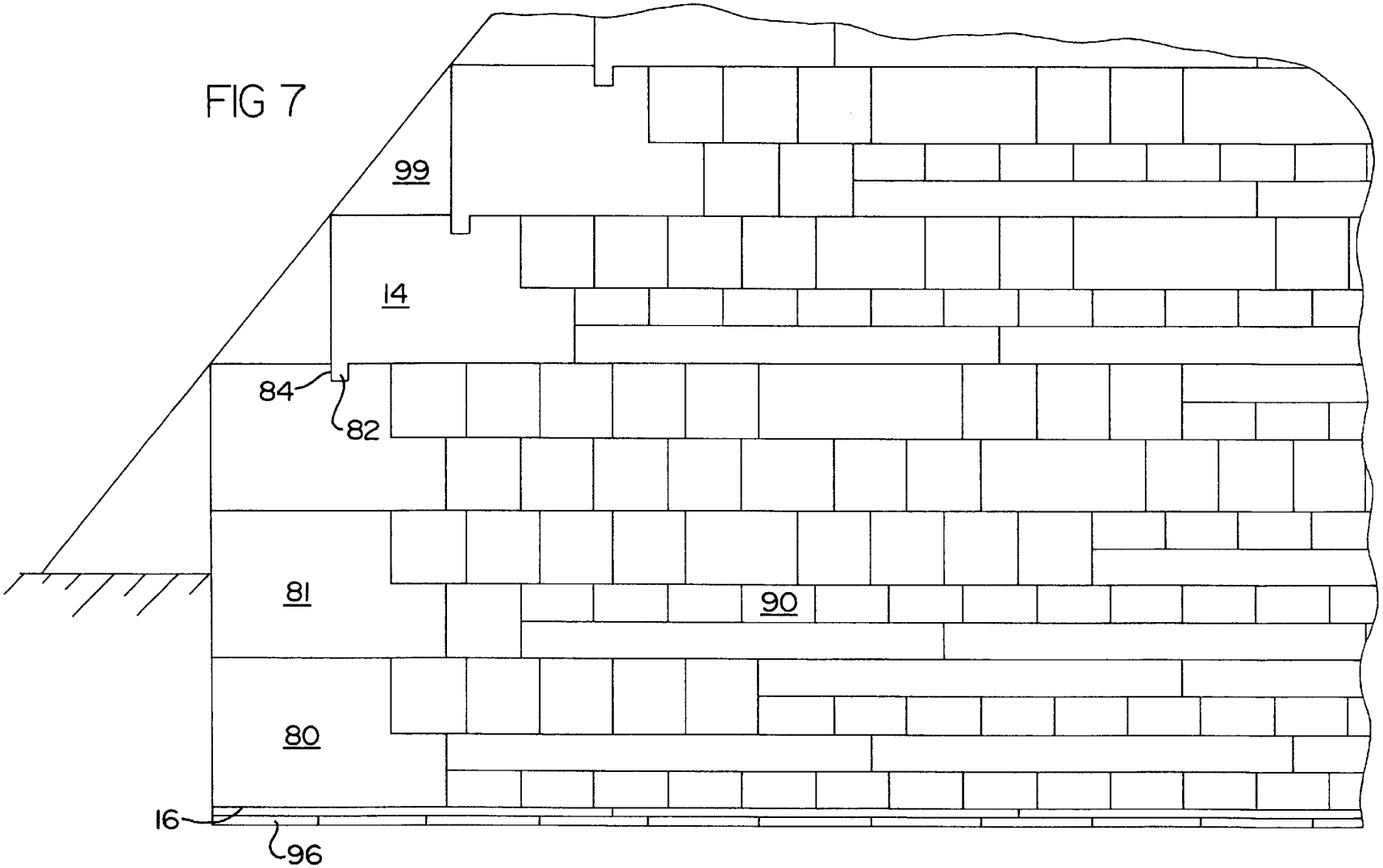
FIG. 7 is a cross-sectional view of the burial structure of the present invention.

Referring now to FIGS. 1–7 of the present invention, there is found therein the present invention, to wit, a burial structure 10 for holding therein the remains of multiple human beings. The burial structure 10 comprises a plurality of individual burial units, an exemplar unit being shown at 12, a plurality of outer blocks, an exemplar block being indicated at 14 and a base flooring 16.

The burial structure 10 is formed in the shape of an obelisk, here especially a pyramid. The shape of the structure is alterable to many desired forms; what is critical is that the disposition of the remains is within the burial structure and in a container that allows for the creation of an overall structure other than a box or another simply utilitarian structure to be achieved. This is fostered primarily by the non-retrievability of the remains therein, as will be discussed herein further below.

An entryway 20 is shown into the burial structure 10. The entryway 20 allows access of visitors to a hallway 21. The hallway 21 may be formed with whatever covering is considered desirable, as is commonly known in mausoleum construction. It is to be understood that no particular location for any particular person will be accessible in the hallway 21, as is commonly found with other mausoleums. There may be displayed within the hallway, however, a "wall of honor", similar to that found in the U.S. Memorial to the Veterans of the Vietnam War.

Referring now to FIGS. 2–4, we see the individual unit for the interment of an individual remains. The unit 12 shown is sized for cremen remains. However, the formation of a whole body unit only differs in the length and width of the unit; the vertical dimensions remain substantially similar to the exemplar unit 12. FIG. 7 depicts various sized units 12, and also for half-sized units, where only one vertical component is elected, as will be discussed herein below. It is noted that no state laws allow the burial of cremens and whole bodies in the same structure, this is noted to indicate the versatility of the structure of the present invention.

The unit 12 comprises an outer container 30, an inner container 32, a cover 34 and means 36 for securing the cover 34 upon the outer container 30. The outer container 30 is generally cubic in design, having an opening 38 formed therein. The opening 38 of the outer container 30 is substantially similar to the formation of the inner container 32, which can then be fully accepted into the opening 38. By this construction, the inner container 32 is fully concealed within the outer container. Once sealed, it is not accessible and is non-retrievable.

The outer container 30 is made of a high impact polymer, such that can withstand potentially thousands of pounds of weight thereupon. A particularly preferred high-impact polymer for the composition of the outer container 30 is produced by GE Plastics in the United States under the trademark name XENOY®. The use of XENOY® and other suitable polymers for such purpose is known, and other such compounds are found in U.S. Pat. No. 5,348,798 issued to Berghuis et alia, the contents of which is incorporated herein by reference.

The inner container 32 is formed into two portions: an upper chamber 50 and a lower chamber 52. Ideally, the lower chamber 52 is intended to hold the remains of the person interred. The upper chamber 50 is ideally intended to hold any personal possession or memorabilia desired to be interred with the remains. All of the parts of the inner container 32 is formed of the same high-impact polymer as the outer container 30. A separating member 54 may be placed between the upper chamber 50 and the lower chamber 52. This separating member 54 will also be comprised of the same high-impact polymer. In a secondary embodiment, no separating member 54 would be used. Rather, the inner container 32 would comprise one large chamber into which multiple remains could be interred, such as of a family or friends desiring common burial. Another alternate embodiment would be to have all pieces of the inner container 32 be free-standing members.

The cover 34 is formed of the same high-impact polymer as are the outer container 30 and inner container 32. The cover 34 has a recessed lid 58 which mates precisely with the seated opening 37 formed in the outer container 30. This effects a tight closure of the remains and other interred objects Once positioned, means 39 for sealing the cover 34 to the outer container 30 may be applied. In the preferred embodiment, the means 39 for sealing comprises an epoxy or, less preferably, a silicon sealer. Once effected, the means 36 for sealing are deployed, comprising in the preferred embodiment of a plurality of stainless steel screws 59, which effect the permanent joining of the cover 34 to the outer container 30. The cover 34 will then solidify together with the outer container 30. The combined effects of the means 36 and the means 39 will ensure an air-tight and permanent attachment of the cover 34 to the container 30.

The cover 34 has on its top, as seen in FIGS. 3 and 6, a crisscross pattern comprises multiple grooves or slots 64. The slots 64 correspond to ridges 62 of an identical pattern formed in the bottom of the outer container 30, as seen in FIGS. 5 and 6. By this intermeshing, a non-shifting stacking of units 12 upon each other. An alternate pattern or means of interlocking stacking can be elected in the alternative. The intersection of the ridges 62 of an outer container 30 and the grooves 64 of a cover 30 comprises a means 19 for interlocking the individual units 12.

It is to be noted that the cross-hatched pattern allows for laying containers at once, at one vertical level, concurrently atop multiple containers directly there below.

Referring now particularly to FIG. 7, there is shown a cross-section of the burial structure 10. The outer blocks 14 are formed of a high strength building material. While materials such as brick, concrete or granite can be used, a high impact polymer is considered ideal. The blocks below ground, indicated at 80 and 81, are only interlocked with the individual burial units 12. Accordingly grooves or slots similar to those found in the covers 34 are found on the upper surfaces thereof. Likewise, bottom surfaces have ridges similar to the outer container 30 formed therein. At ground level and above, the blocks 14 may have a flange 82 which is fitted into a slot 84 formed in the block there below. This plurality of interlocking structures gives stability to these members and the structure 10.

As is depicted in FIGS. 1–7, the individual units 12 are disposed in varying sizes and orientations. It is to be noted that a half-sized container, an exemplar container being indicated at 90, is essentially an outer container 34 without the upper chamber 50; thus only a lower chamber 52. This is useful for cremens of small children, cremens that are otherwise smaller, and for significant memorabilia. Such half-sized containers are placed atop other half-size units, which together comprise one (1) full-size unit. These can then be placed parallel to each other, or at right angles. The choice of how many of each type of unit to utilize will depend upon the types of remains to be resident in the structure, and can be flexed to accommodate individual cases and circumstances.

The flooring 16 is ideally a sheet of high-impact polymer, having formed thereon ridges similar to the ridges 62 formed on the covers 34. Alternately, on this base level only, no intermeshing can occur, the weight of the entire structure 10 acting to anchor the structure 10. A layer below the flooring, shown at 96, could be included. The layer 96 is ideally formed of a high impact polymer, similar to the containers 30. Alternately, the floor 96 can be made of concrete, brick or tile.

It is to be understood that the choice of an obelisk for the shape of the structure 10 is something that is changeable to cultural and/or religious desires or architectural and/or structural requirements. For example, in Moslem countries a shape such as the sacred cube in Mecca could be imitated in other locations. In a Christian setting, a statue of Jesus or other person, or even a symbol, like the cross, could be formed. Where alternative religions and beliefs are present, any suitable shape could be chosen. Theme structures, such as in the shape of a university logo or seal, could also be elected.

In the obelisk of FIG. 7, there is also seen facade pieces 99 deployed thereon. These facade pieces could give a certain color and texture desired in a structure, but are not necessary to the practicing of the present invention.

What is claimed is:

1. A burial structure for the non-retrievable interment of multiple human remains and any associated memorabilia, the burial structure comprising:

(a) a plurality of individual burial units, each burial unit comprising:

(1) an outer container having a chamber formed therein;

(2) an inner container fitted into the chamber of the outer container, the inner container having a lower chamber formed therein for holding the human remains to be stored in the individual burial unit, the inner container further having an upper chamber formed therein where memorabilia may be stored;

(3) a cover; and (b) a plurality of outer blocks surrounding collectively and capping the individual burial units such that no individual burial unit is accessible;

wherein the individual burial units directly contribute to the formation of the aesthetical portion of the burial structure.

2. The burial structure of claim 1, wherein the structure further comprises an entryway and a main hallway.

3. The burial structure of claim 1, further comprising a flooring upon which the containers and outer blocks are deployed atop.

4. The burial structure of claim 1, further comprising means for securing the cover to the outer container.

5. The burial structure of claim 1, further comprising a separating member placed in the inner container, the separating member being placed between the upper chamber and the lower chamber of the inner container.

6. The burial structure of claim 1, further comprising means for interlocking the containers stacked atop each other.

7. A burial structure for the non-retrievable interment of human remains and any associated memorabilia therewith while forming a lasting memorial structure thereby to those therein interred, the burial structure comprising:

(a) a floor;

(b) a plurality of individual burial units to hold the human remains, each individual burial unit comprising:

(1) an outer container having a bottom and a plurality of side walls cooperating to define a chamber formed therein;

(2) an inner container fitted into the chamber of the outer container, the inner container having a lower chamber formed therein for holding human remains to be stored in the individual burial unit, the inner container further having an upper chamber formed therein where memorabilia may be stored;

(3) a cover fitted atop the side walls parallel to the bottom of the outer container and acting to seal the chamber formed therein the outer container, wherein each individual burial unit is either mounted upon the floor or upon another individual burial unit;

(c) a plurality of outer blocks, the blocks being deployed upon the floor circumferentially about the deployment of the individual burial units or being deployed upon each other such that the outer blocks collectively surround the individual burial units and no individual burial unit is accessible, the blocks having means for interlocking with each other, the blocks providing the outer shell and protection for the burial structure.

8. The burial structure of claim 7, wherein the containers are formed of a high impact polymer.

9. The burial structure of claim 7, further comprising means for securing each cover to the side walls of its respective container.

10. The burial structure of claim 7, wherein the floor has formed therein a plurality of slots.

11. The burial structure of claim 7, wherein the slots formed in the floor are deployed in a cross-hatch pattern.

12. The burial structure of claim 7, wherein the bottom of each container has formed thereon a plurality of ridges, and the cover of each container has formed therein a plurality of slots, wherein the ridges and slots are so formed as to be capable of mating and thereby interlocking the containers.

13. The burial structure of claim 8, wherein the bottom of each container has formed thereon a plurality of ridges, and the cover of each container has formed therein a plurality of slots, wherein the ridges of the containers and the slots of the floor and the covers are so formed as to be capable of mating and thereby interlocking the containers and the floor.

14. The burial structure of claim 7, wherein the outer blocks have means for mating with the slots formed in the floor.

15. The burial structure of claim 7, further comprising means for securing the cover to the outer container of each individual burial unit, and means for sealing the cover to the outer container of each individual burial unit.

16. The burial structure of claim 15, further comprising a capstone outer block, the capstone outer block being interlocking with the surrounding outer blocks onto which it is mounted, the capstone outer block and all other outer blocks cooperating to secure the burial container therewithin, the capstone block being sealable atop the containers and outer blocks upon which it is deployed.

17. The burial structure of claim 7, wherein the containers and outer blocks are so disposed as to form a hallway and an entrance to the hallway substantially at ground level, the hallway being formed by outer blocks within the structure, such that the containers are not readily accessible from the hallway.

18. The burial structure of claim 7, further comprising means for securing the cover to the outer container of each individual burial unit.

19. The burial structure of claim 7, further comprising means for sealing the cover to the outer container of each individual burial unit.

20. A burial structure for the non-retrievable interment of human remains and any associated memorabilia therewith while forming a lasting memorial structure to those thus interred, the burial structure comprising:

(a) a floor having a plurality of slots formed therein, the floor is to be deployed below the grade of the land by a minimum of thirty feet;

(b) a plurality of burial containers, the burial containers comprising at least one compartment formed of a high impact polymer, each burial container having a cover, a bottom and a plurality of sides cooperating to define an interior chamber, the chamber being where the human remains or memorabilia will be interred, the cover being mountable upon the plurality of sides to close the chamber, wherein the cover of each container has formed therein a plurality of slots in a manner similar to the floor, and wherein further the bottom of each container has a plurality of ridges formed thereto, the ridges being capable of interlocking insertion into the slots of either the floor or the top of another container, and wherein further the containers are stacked upon the floor and each other in an interlocking manner to provide greater building stability and to allow a hallway to be formed therein, the interlocking of containers serving as building blocks for the memorial structure;

(c) means to secure the cover to the outer container of each individual burial unit;

(d) a plurality of outer blocks deployed upon the floor and circumferentially around all containers, outer blocks being deployed further in a stacking manner atop other outer blocks so as to enclose all containers therein while allowing for a hallway entrance to be formed, the outer blocks serving to seal the containers from both the ground and the outside atmosphere, the blocks being water and gas impermeable, the blocks having means for interlocking so as to comprise a barrier to access to the containers therein;

(e) means for sealing the cover to the outer container of each individual burial unit; and (f) a capstone block which is sealed to the top of the burial structure to seal off the structure.

* * * * *